United States Patent [19]

Nandagiri

[11] Patent Number: 4,530,450

[45] Date of Patent: Jul. 23, 1985

[54] AEROSOL DISPENSING SYSTEM

[75] Inventor: Arun Nandagiri, Redding, Calif.

[73] Assignee: American Cyanamid Co., Stamford, Conn.

[21] Appl. No.: 464,452

[22] Filed: Feb. 7, 1983

[51] Int. Cl.[3] ..... B65D 83/00

[52] U.S. Cl. ..... 222/402.1; 222/464; 55/159

[58] Field of Search ..... 222/402, 402.1, 402.18, 222/402.2, 189, 211, 464, 129, 394; 135, 145; 239/337, 340, 372; 55/159

[56] References Cited

U.S. PATENT DOCUMENTS

| | | | |
|---|---|---|---|
| 3,206,939 | 9/1965 | Wilson | 55/159 |
| 3,260,421 | 7/1966 | Rabussier | 222/464 |
| 3,490,655 | 1/1970 | Ledgett | 222/464 |
| 4,398,654 | 8/1983 | Pong et al. | 222/402.1 |

*Primary Examiner*—Joseph J. Rolla
*Assistant Examiner*—Kenneth Noland
*Attorney, Agent, or Firm*—Charles J. Fickey

[57] ABSTRACT

An aerosol dispensing device for a three phase system which dispenses the product in a uniform fine mist at a high spray rate. The aerosol package has a porous plastic diptube with graduated porosity along its length, the porosity increasing towards the lower end of the tube.

7 Claims, 3 Drawing Figures

AEROSOL DISPENSING SYSTEM

The present invention relates generally to aerosol devices to dispense two immiscible liquid phases in a three phase system as a fine, dry spray. More particularly, it relates to a novel valve/diptube assembly for dispensing two immiscible liquid phases in a three-phase system, one of which is a gaseous propellant phase.

It will be understood that a wide variety of substances have been dispensed from pressurized containers under the influence of a gaseous propellant. These systems are the well-known aerosol products, which have used fluorocarbon or hydrocarbons (condensed gases) or compressed gases, such as carbon dioxide. Generally, in these systems, the material to be dispensed, if a solid, is suspended in the liquified propellant (for example, antiperspirant compositions); if a liquid, either a single liquid phase is formed by dissolution of the liquified propellant therein and the product dispensed by the propellant vapor, or the liquid may be dispensed by a compressed gas, such as $CO_2$. Usually a valved eduction tube, open at the bottom, provides for the propellant to force the material to be dispensed up the eduction tube and out of the container. These systems are known as two-phase systems—phase I being an upper layer of propellant gas and phase II being a liquid or a solid suspended in a liquid.

If, however, the product to be dispensed is of the nature of two immiscible liquids, for example, an aqueous solution and a liquified hydrocarbon propellant, difficulty is encountered. Such systems are three-phase systems and conventional valve/diptube assemblies are incapable of handling them. In the three-phase system, phase I is either a compressed gas or a vaporized propellant, such as hydrocarbon gas; phases II and III are immiscible liquid phases, one of which may be a liquified propellant. An example of a three-phase system is an aqueous solution of a product as phase III dispensed using a hydrocarbon propellant wherein phase II is liquified hydrocarbon propellant and phase I is gaseous hydrocarbon propellant.

Conventionally, an aerosol valve is fitted with a diptube (eduction tube) extending to a point near the bottom of the container and into the product to be dispensed. The product flows under influence of the propellant up through the eduction tube into the valve housing and is dispensed through the valve button. A vapor tap, which usually opens into the body of the valve to mix gaseous propellant with the product stream, may be included in the device.

Technology is available today to formulate aerosol products, including certain hair sprays, as solutions in water, or in water-alcohol solutions in which hydrocarbon propellants are insoluble. The aerosol product is present in the package as three distinct phases, as described above. This presents a problem of delivery in the aerosol package, since the package should be shaken to mix phases II and III, and this does not necessarily provide a uniform mixture. The mixture may also vary with each use, since the amount of shaking to obtain mixing may not always be the same.

In copending, commonly assigned application Ser. No. 136,206, filed Apr. 1, 1980 now U.S. Pat. No. 4,398,654, aerosol means is disclosed for dispensing two immisible liquid phases in a three-phase system, which comprises a valve means and a diptube means adapted to draw off simultaneously both liquid phases to the valve means; said diptube means extending to a point near the bottom of the aerosol container and comprising means preferentially permeable or permeable only to a first liquid phase, and means preferentially permeable or permeable only to a second liquid phase, both means being substantially impermeable to the gaseous propellant. In one embodiment of the invention of the copending application, a porous plastic diptube, open at the bottom, was used. In a system having a water-alcohol solution of a product, the aerosol package contents could separate into three distinct layers (depending upon the amount of water used), phase III, the water-alcohol solution, is at the bottom; phase II, the liquified propellant is in the middle; and phase I, vaporized liquid propellant, is at the top. The porous plastic diptube is preferentially permeable only to phase II. When the aerosol valve is opened, the pressure of the propellant forces phase III product up through the diptube through the open lower end, phase II liquid propellant through the walls of the diptube so that it mixes with phase III product and vaporizes to dispense product as a uniform fine spray. Although this system has been found to be superior in dispensing to a conventional aerosol system it was found that some variation in the ratio of propellant to product phases dispensed occurs as the contents of the aerosol package are consumed. This is due to the fact that phase III is always dispensed through the opening in the bottom of the tube and this opening will be uniform throughout the use of the package. On the other hand, the quantity of liquified propellant is continuously decreasing, so that the vertical distance it covers on the outside of the tube also decreases. This results in less liquified propellant coming through the tube.

It is therefore an object of this invention to provide an aerosol system for dispensing at least two immiscible liquids in a continuous uniform ratio.

This and other objects of the invention will become apparent as the description thereof proceeds.

The means provided by the present invention may comprise various adaptations of the aforementioned principle, as shown in the accompanying drawings.

Accordingly, it is an object of the present invention to provide an improved pressurized aerosol package and delivery system for a three-phase composition.

Another object of the invention is to provide a valve and diptube device to dispense, at a uniform rate, a product which is insoluble in and immiscible with the propellant.

Another object of the invention is to provide a valve and diptube means to dispense, at a uniform rate a fine mist spray of a water-based product using a water-immiscible hydrocarbon propellant.

These and other objects of the invention will become apparent as the description thereof proceeds.

Figure 1:
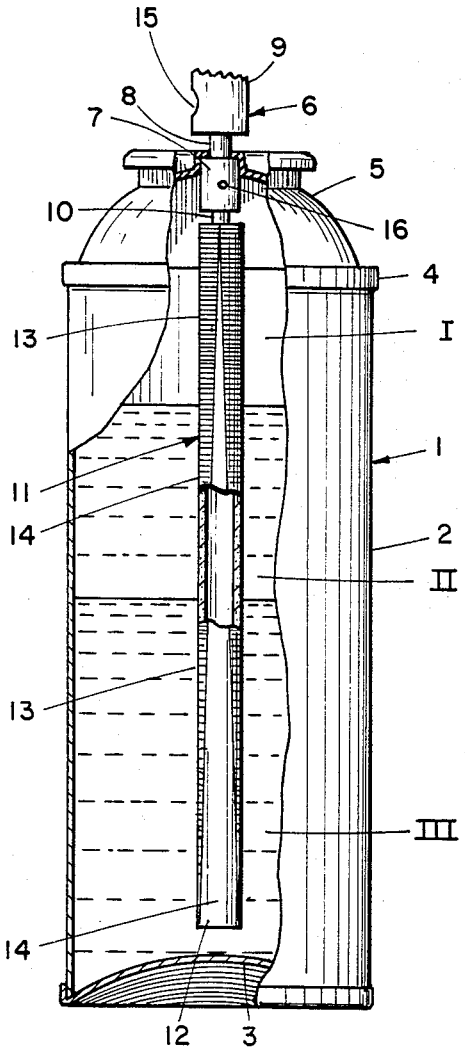
FIG. 1 is a side view in elevation, with parts broken away, of the pressurized aerosol container for use with a three-phase system.

Referring to FIG. 1, a three-phase aerosol system is shown having container 1 with body 2, bottom 3, collar 4 and top 5. A valve member 6 fits into top 5. Valve member 6 comprises a conventional aerosol valve, a housing 7, a stem 8, spray head 9, and a tailpiece 10, to which a porous diptube 11 is attached.

The aerosol container 1 as shown has a three phase system, in which for example, phase I is vaporized propellant, phase II is liquified propellant and phase III is a liquid product not miscible with the propellant and which is heavier than the liquid propellant. For example, the propellant may be a hydrocarbon, e.g. butane and the product phase may be a water-based hair spray. Diptube 11 extends to the bottom of container 1 and has an opening 12 at the lower end of the tube. Diptube 11 is formed of a poromeric plastic and has increasing porosity from top to bottom, i.e. it is more porous at its lower end. However, the porosity gradient is such that it is still only permeable to the phase II throughout its entire length. As shown in the embodiment of FIG. 1, the porosity gradient is obtained by applying an impermeable coating 13 (i.e. a coating impermeable to phase II) over tube 11. Any suitable coating material may be used, e.g. epoxy adhesives, rubber paints and the like, which are not reactive with the contents of the aerosol package. The coating is applied in a pattern such that the area of the tube coated is greater at the top end of the tube and least at the bottom. Thus the permeable area 14 of tube 11 increases towards the bottom of the tube.

In operation, valve spray head 9 of valve 6 is depressed, gaseous propellant phase I exerts pressure and causes product phase III to enter opening 12 of diptube 11 and travels upward. Liquified propellant phase II passes through the porous walls of tube 11, and mixes with product and the mixture passes out through valve 6, spray head 9 and orifice 15.

As the product is used up, the vapor phase area I, increases and liquified vapor phase II decreases. However, since tube 11 is substantially impermeable to phase I it does not allow gaseous phase I to pass through. Due to the patterning of coating 13 on tube 11, the area of tube 11 through which phase II can permeate increases towards the lower end of tube 11. Thus, as the area of phase II decreases, the area 13 of tube 11, through which phase II can permeate increases. This maintains the flow of phase II substantially constant throughout the use of the aerosol package, and thus also maintains a constant ratio of phase II to phase III to assure that the product always is dispensed as a uniform fine spray which remains constant throughout the life of the aerosol package. A vapor tap 16 can be added optionally to admit phase I vapor to aid in draining phases II and III when the unit is not operating. This draining is desirable for optimum performance so that a burst of liquid propellant is not obtained at any time. The function described above is unlike the use of conventional vapor tap described in the prior art when vapor is admitted to enhance mixing.

Figure 2:
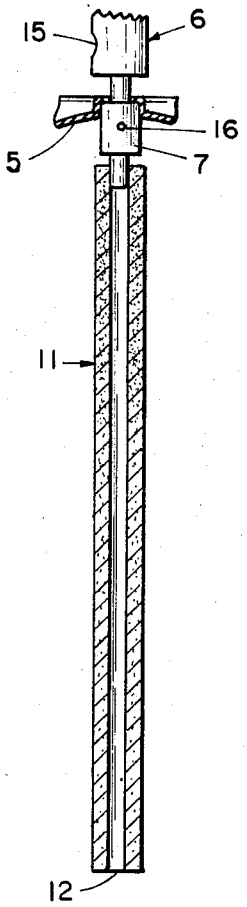
FIGS. 2 and 3 represent alternative constructions for the valve and diptube assemblies of the present invention.
Figure 3:
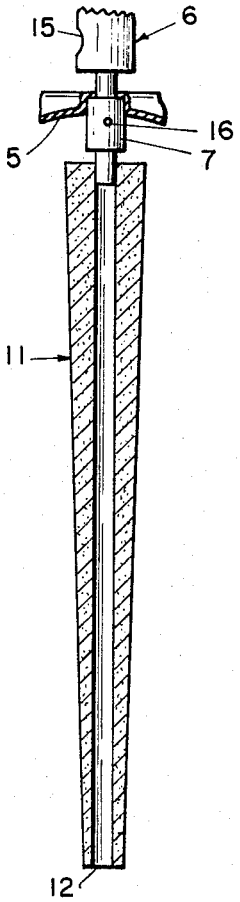

In FIGS. 2 and 3, alternative methods for providing a porosity gradient over the length of the diptube 11 are shown. In FIG. 2, the diptube is not coated on the outside to seal pores, as in the embodiment of FIG. 1, but the pores are made smaller or fewer in number at the upper end of the tube. This can be done either by using higher pressure or higher heat at the upper end while sintering during formation of the tube.

In FIG. 3, increasing porosity towards the bottom of the tube is obtained by making the diptube walls thick at the top and thinner at the bottom.

The basic permeable diptube may be a poromeric plastic, such as polystyrene, polyethylene, polypropylene, nylon, polycarbonates, teflon, polyvinylchloride. These poromeric materials are characterized by having multidirectional pores throughout the plastic mass. The pore size may vary from about 0.1 to 30 microns and larger and the pore density, the measure of pores per unit area, typically may be 70 percent, but may be lower or higher. The pore size desired will be dependent on a number of factors such as the internal diameter of the tube, the viscosity of the fluid concentrate. In one particular application a tube having an internal diameter of 1/16 inch was used with a hair spray concentrate having a porosity of about 7 centistokes. In this instance, the desired pore size is from 1 to 5 microns and the pore density is from about 50 to 70 percent.

The poromeric tube may be prepared by a number of different methods.

In one method, the tube is made by casting of a polymer solution. A solution of polymer in which the compatibility of the solute and solvent is highly temperature dependent is cast or extruded. The solvent separates from the solute to form globules suspended in a polymer-solvent matrix. Removal of the solvent yields a porous material. Pore size is determined by the solution behavior of the components used and the rate of cooling of the solution and ranges from 0.1 microns to 11 microns.

In another method, the tube is made by sintering of plastic beads in molds. Beads of plastic are rounded (made spherical) and sorted for size. The pore size is determined by the bead size and typically ranges from 10 microns to 30 microns and larger with normal techniques but can be made down to 0.2 microns with special techniques.

A third method for making the diptube is by extrusion of a plastic with starch or salt suspended within. The starch or salt is removed by extraction in a hot bath. The starch requires hydrolysis to sugar by including acid in the extraction process. The size of the pores produced is dependent on the size of the salt or starch particles used and ranges from 10 microns downward. A pore density of 70 percent is obtained.

It will be understood that the present invention is also applicable in an aerosol system having a valve and diptube means with more than one diptube. Such a system is disclosed in copending commonly assigned application Ser. No. 136,206, filed Apr. 1, 1980. In such a system, a porous plastic diptube, closed at the bottom is attached to the valve at one opening, and a second nonporous diptube, open at the lower end, is attached to a second opening in the valve. The product, phase III, goes to the valve through the nonporous diptube, and the liquified propellant passes through the walls of the porous diptube. It will be clear that the porous diptube in this system can be made with a varying porosity gradient from top to bottom.

Following are Examples of formulations which may be dispensed in the inventive container and valve assembly of the present invention.

| Example I<br>Insecticide | % w/w |
|---|---|
| Pyrethrins | 0.25 |
| Piperonyl Butoxide | 1.25 |
| Fragrance | 0.20 |
| Petroleum Distillate | 1.25 |
| Deionized Water | 67.05 |
| Isobutane | 30.00 |
| | 100.00 |

| Example II Space Deodorant | % w/w |
|---|---|
| Perfume | 1.50 |
| Deionized Water | 73.50 |
| Isobutane | 25.00 |
| | 100.00 |

| Example III Antiperspirant | % w/w |
|---|---|
| Aluminum Chlorhydrol (water soluble) | 15.00 |
| Perfume | 0.50 |
| Deionized Water | 44.50 |
| Isobutane | 25.00 |
| Alcohol 190 Proof | 15.00 |
| | 100.00 |

| Example IV Deodorant | % w/w |
|---|---|
| Alcohol 190 Proof | 20.00 |
| Perfume | 1.50 |
| Deionized Water | 53.50 |
| Isobutane | 25.00 |
| | 100.00 |

| Example V Hair Spray | % w/w |
|---|---|
| Alcohol 190 Proof | 43.72 |
| Gantrez ES 225 | 6.00 |
| A.M.P. | 0.13 |

-continued

| Example V Hair Spray | % w/w |
|---|---|
| Deionized Water | 25.00 |
| Perfume | 0.15 |
| Isobutane | 25.00 |
| | 100.00 |

I claim:

1. Valve and diptube means for a pressurized aerosol container, containing two immiscible liquid phases and a vapor phase therein; said valve and diptube means adapted to simultaneously draw off both liquid phases to said valve means; said valve and diptube means comprising a hollow plastic diptube extending to a point near the bottom of said container and open at the lower end thereof, and being preferentially permeable to the upper of said liquid phases and preferentially impermeable to said vapor phase and said lower liquid phase, said diptube having increasing permeability to said upper liquid phase towards its lower end.

2. Valve and diptube means for a pressurized aerosol container according to claim 1, wherein one of said liquid phases is an aqueous hydroalcoholic solution and the other liquid phase, immiscible therewith, comprises a liquified hydrocarbon propellant.

3. Valve and diptube means for a pressurized aerosol container according to claim 1, wherein one of said liquid phases is an aqueous or hydroalcoholic solution, the other liquid phase is a liquid or solution immiscible with the aqueous or hydroalcoholic phase, and the vapor phase is a compressed gas.

4. Valve and diptube means as in claim 3 wherein said compressed gas is carbon dioxide.

5. An aerosol package comprising a container under pressure of a vaporized propellant and a liquified product immiscible with said propellant, and a valve and diptube means as in claim 1.

6. An aerosol package comprising a container having therein two immiscible liquid phase and a compressed gas; and a valve and diptube means as in claim 1.

7. An aerosol package as in claim 6, wherein said compressed gas is carbon dioxide.

* * * * *